US006708909B2

(12) United States Patent
Toda et al.

(10) Patent No.: US 6,708,909 B2
(45) Date of Patent: Mar. 23, 2004

(54) SEPARATION DEVICE FOR UNBURNED CARBON IN FLY ASH AND SEPARATION METHOD

(75) Inventors: Yasuhiro Toda, Shizuoka (JP); Sadatoshi Kojima, Tokyo (JP); Takeshi Yamamoto, Abiko (JP)

(73) Assignee: Nikkiso Co., Ltd., Tokyo (JP)

( * ) Notice: Subject to any disclaimer, the term of this patent is extended or adjusted under 35 U.S.C. 154(b) by 145 days.

(21) Appl. No.: 09/891,102

(22) Filed: Jun. 25, 2001

(65) Prior Publication Data

US 2002/0014157 A1 Feb. 7, 2002

(30) Foreign Application Priority Data

Jun. 26, 2000 (JP) ..... 2000-190874
Apr. 13, 2001 (JP) ..... 2001-114758

(51) Int. Cl.[7] ..... B02C 19/12; B02C 19/06

(52) U.S. Cl. ..... 241/1; 241/5; 241/26; 241/39; 241/284

(58) Field of Search ..... 241/1, 5, 39, 284, 241/26

(56) References Cited

U.S. PATENT DOCUMENTS 1,573,017 A * 2/1926 Podszus ..... 241/284
1,671,678 A * 5/1928 Kramer et al. ..... 241/284
1,798,886 A * 3/1931 Kramer ..... 241/284

FOREIGN PATENT DOCUMENTS

JP 04040246 2/1992
JP 783840 9/1995
JP 63158179 7/1998

* cited by examiner

*Primary Examiner*—Mark Rosenbaum
(74) *Attorney, Agent, or Firm*—Darby & Darby

(57) ABSTRACT

A separation device includes a casing and a first and a second rotation blade. A pulverization chamber is defined between the casing, the first, and the second rotation blade. Operating an urging device and at least one of the first and the second rotation blades, creates channeling vortices within the pulverization chamber. Fly ash containing unburned carbon is feed into the pulverization chamber, and through at least repeated self-collision, unburned carbon is segregated and reduced in size while remaining particular matter is similarly segregated and reduced in size. A method implements the separation device and provides simple results.

24 Claims, 3 Drawing Sheets

SEPARATION DEVICE FOR UNBURNED CARBON IN FLY ASH AND SEPARATION METHOD

BACKGROUND OF THE INVENTION

1. Field of the Invention

The present invention is a device for separating unburned carbon in fly ash and a separation method for the same. In particular, the present invention pertains to a device which lowers unburned carbon content in aggregated fly ash particles by separating the particles, and refining the particles into smaller sizes for later use.

2. Description of the Related Art

Referring now to FIG. 4, in a coal fired power plant (not shown), coal is pulverized in a pulverizing device 40 to an average particle size of roughly 15–40 micrometers (μm). The coal is then mixed with air at an entrance to a boiler (not shown), where it is burned inside a combustion chamber 41 linked to pulverization device 40. In addition to the carbon content in the coal (fuel), there is approximately 5–30 weight % of ash material. Typically, the ash material is not burned in the above process but is discharged as an undesirable waste product called coal ash at multiple process positions, as will be described.

The components of the discharged coal ash are approximately 40–60 weight % silicon oxide, 20–30 weight % aluminum oxide (alumina oxide), 5–10 weight % calcium oxide, 3–8 weight % iron oxide, 2–10 weight % unburned carbon, and other minor particles. Depending on the origin of the coal used, the discharged coal ash may be alternatively classified as clinker ash, cinder ash, or fly ash. The components of each substance vary slightly due to original composition and processing.

Clinker ash is collected from a boiler furnace bottom part 42 positioned below combustion chamber 41, and is typified as a solid glass-type material. The clinker ash is thereafter pulverized and discharged in a conveniently handled size of approximately 0.5–1 millimeters (mm) (500–1000 μm). Clinker ash comprises approximately 10–20% of the ash or coal ash waste.

Cinder ash is ash that falls into a fuel economizer 43 positioned down-process from combustion chamber 41. The cinder ash is collected as spherical particles having an average particle size of 30–70 micrometers (μm) or as aggregates of these spherical particles. Cinder ash comprises approximately 5% of the ash.

Fly ash is ash collected in an electric precipitator 44 positioned down-process from fuel economizer 43. Fly ash is collected as spherical particles of average particle size 10–30 micrometers (μm) or as aggregates of the spherical particles. Fly ash comprises approximately 70–80% of the ash.

Cinder ash and fly ash, are liquefied in air during formation by the heat of combustion, and thereafter cool to form typically spherical particles. These typically spherical particles of cinder ash and fly ash, have an average particle size of 10–70 micrometers (μm) or may form as aggregates of these particles.

It should be understood from the above, that unburned carbon typically adheres to the pseudo-spherical particles of the ash component or is mixed in independently.

Unfortunately, a large amount of fly ash is discharged as undesirable waste in landfills increasing costs, consuming space, and forming industrial waste.

Even where fly ash with a high unburned carbon content is later used as a clay substitute material in cement, there is a limit to the amount that can be consumed in this manner. Ultimately, a large amount of fly ash must still be disposed of in landfills. Fly ash with low unburned carbon content and small particle size may be used as an admixture for ready-mixed concrete, also within a useful limit. In sum, while there are some uses for the fly ash, the demand is insufficient for the supply and undesirable waste results.

Even if new uses are developed, the particle size, color, and particularly the residual carbon amount and the variability of each of these items make their uniform efficient utilization both difficult and costly. Due to these variabilities, it is difficult to develop new uses for fly ash as a raw material. In sum, it is essential to reduce the unburned carbon content to a preferable and controllable range and so use the fly ash as a new raw material.

Many methods have been attempted to classify the unburned carbon content of ash, including, sieve classification, electrostatic classification, wet classification, vibration classification, jet mill classification. Each has an advantage and a disadvantage but none has been used in common practice or with great success.

Among these methods, a jet mill (or fluid energy mill), in which classification is conducted after fly ash particles collide with each other and pulverized, has been gathering interest. Unfortunately, jet mills have multiple problems. These problems include complex construction, difficult maintenance, and high costs, and difficulty in simple classification, each serving as a barrier to implementation.

OBJECTS AND SUMMARY OF THE INVENTION

It is an object of the present invention to overcome the concerns listed above in a useful and inexpensive manner.

It is another object of the present invention to provide a separation device for unburned carbon that has a simple construction and can easily and effectively separate and remove unburned carbon in fly ash.

It is another object of the present invention to provide a separation method employing the device.

It is another object of the present invention to provide an unburned carbon separation device and a separation method in which abrasion on the apparatus is minimized, powder classification can be easily adjusted according to an input powder, and maintenance is easy and inexpensive.

Briefly stated the present invention is a separation device which includes a casing and a first and a second rotation blade. A pulverization chamber is defined between the casing, the first, and the second rotation blade. Operating a suction device and the first and the second rotation blades, creates channeling vortices within the pulverization chamber. Fly ash containing unburned carbon is fed into the pulverization chamber, and through repeated self-collision, unburned carbon is segregated and reduced in size while remaining particular matter is similarly segregated and reduced in size. A method employs the device and provides simple separation and segregation.

According to the present invention there is provided a separation device, comprising: a casing, the casing includes an inlet for receiving a first material containing at least an unburned carbon portion into the casing, first means for separating the first material into the unburned carbon portion and a second portion, the first means includes second means for reducing in size the unburned carbon portion into a first reduced-size portion and the second portion into a second reduced-size portion, the first means in the casing, and segregation means for receiving the first reduced-size portion and the second reduced-size portion from the casing and segregating the first reduced-size portion from the second reduced-size portion for later use whereby the separation device operates economically and effectively.

It is to be understood, that untreated fly ash is mainly, but not solely, a mixture of silicon oxide particles, aluminum oxide particles, and unburned carbon particles.

According to another embodiment of the present invention, there is provided a separation device, comprising: at least one of the first means, the second means and the segregation means being adjustable according to at least one of a size, a density, and an unburned carbon content of the first material whereby the separation device operates economically and accommodates material variation in the first material.

According to another embodiment of the present invention, there is provided a separation device, comprising: a first rotation blade in the first means, the first rotation blade having a first rotation axis, a second rotation blade in the first means, the second rotation blade having a second rotation axis, the first rotation blade opposing the second rotation blade in the casing along a common axis of rotation, and a pulverization chamber defined between the casing and the first rotation blade and the second rotation blade.

According to another embodiment of the present invention, there is provided a separation device, wherein: the pulverization chamber includes a first width defined as a separation between the first rotation blade and the second rotation blade, and the first width being adjustable according to at least the size, the density, and the unburned carbon content of the first material, whereby the separation device is adaptable according to variations in the first material.

According to another embodiment of the present invention, there is provided a separation device, wherein: the first rotation blade includes a blade quantity and a first shape adapted to an inside surface of the casing, the second rotation blade includes a blade quantity and a second shape adapted to the inside surface of the casing, at least one of the first rotation blade and the second rotation blade being rotationally operable at least one of an opposite direction and a same direction of at least the other of the first rotation blade and the second rotation blade, and the first rotation blade and the second rotation blade being rotationally operable according to the inside surface to create circulating vortices within the casing sufficient to cause the separation and the reduction in size of the first material by fracture impact and shear stress.

According to another embodiment of the present invention, there is provided a separation device, further comprising: a suction device, a connecting channel connects the suction device to the casing, and the suction device drawing gas into the inlet, over the first rotation blade, into the pulverization chamber, and over the second rotation blade to the segregation means to assist the vortices to transport the first material into the separation device for processing.

According to another embodiment of the present invention, there is provided a separation device, further comprising: at least one of a first and a second outlet opening on the casing, and the at least one outlet opening receiving the first reduced-size portion and the second reduced-size portion from the casing and transferring the first reduced-size portion and the second reduced-size portion to the segregation means.

According to another embodiment of the present invention, there is provided a separation device, further comprising: a first storage part in the segregation means, a second storage part in the segregation means, the first storage part formed for receiving and segregating the first reduced-size portion depending upon a particle size and a mass of the first reduced-size portion, and the second storage part formed for receiving and segregating the second reduced-size portion depending upon a particle size and a mass of the second reduced size-portion, whereby the separation device provides easy separation of the unburned carbon from the second portion.

According to another embodiment of the present invention, there is provided a separation device, further comprising: the first and the second outlet opening, the first outlet opening at a first position on the casing adjacent the first rotation axis receives the first reduced-size portion, and the second outlet opening at a second position on the casing adjacent an outer circumference of the second rotation blade receives the second reduced-size portion, whereby segregation of particle size and mass is simplified.

According to another embodiment of the present invention, there is provided a separation device, wherein: the first inlet opening is at a third position on the casing adjacent an outer circumference of the first rotation blade.

According to another embodiment of the present invention, there is provided a separation device, further comprising: a classification device in the segregation means, the connecting channel connects the classification device to the casing, and the classification device receives discharged particles of the first reduced-size portion and the second reduced-size portion and uses differences in mass and density of the discharged particles to classify them for later use.

According to another embodiment of the present invention, there is provided a method for separating unburned carbon in a first material containing both an unburned carbon portion and a second portion, comprising the steps of: forming a pulverization chamber between a bounding casing and a first and a second rotation blade, the first and the second rotation blades disposed on opposing sides of the pulverization chamber along a common rotational centerline, rotating at least one of the first and the second rotation blades about the common rotational centerline sufficient to create colliding vortices within the pulverization chamber and the bounding casing, supplying the first material as particles into the bounding casing from a first position on the bounding casing and the unburned carbon portion having a first specific gravity lower than a second specific gravity of the second portion, separating the first material into the unburned carbon portion and the second portion through at least one of a first process of self-collision with other first material particles and a second process of equipment-collision with the bounding casing and the first and the second rotation blades, reducing in size the unburned carbon portion and the second portion through repeated the at least on process, and segregating the reduced in size unburned carbon portion from the reduced in size second portion, whereby the method for separating operates effectively with increased speed and efficiency.

According to another embodiment of the present invention, there is provided a method for separating unburned carbon in a first material containing both an unburned carbon portion and a second portion, further comprising the steps of: receiving the reduced in size and the segregated unburned carbon portion in a first discharge opening on the bounding casing, and receiving the reduced in size and segregated second portion in a second discharge opening on the bounding casing, whereby the first material is efficiently and simply pulverized, reduced in size, and segregated for later use.

According to another embodiment of the present invention, there is provided a method for separating unburned carbon in a first material containing both an unburned carbon portion and a second portion, wherein: the first position on the bounding casing surface is adjacent an outer circumference of the first rotation blade, the first discharge opening is adjacent a rotation center axis of the second rotation blade, whereby the unburned carbon particles having lower centrifugal force than the second portion are easier to separate, and the second discharge opening on the casing is adjacent an outer perimeter portion of the second rotation blade, where the second portion having a higher centrifugal force that the unburned carbon portion are easier to separate.

According to another embodiment of the present invention, there is provided a method for separating unburned carbon in a first material containing both an unburned carbon portion and a second portion, comprising the steps of: forming a pulverization chamber between a first rotation blade and a second rotation blade disposed in an opposing manner along a single rotational axis, supplying the first material in particulate form to the pulverization chamber of a first side adjacent the first rotation blade, operating at least one of the first rotation blade and the second rotation blade along the single rotational axis and providing colliding air vortices within the pulverization chamber, colliding particles of the first material on the colliding air vortices with each other to separate the unburned carbon portion from the second portion, pulverizing the unburned carbon portion and the second portion by repeated collision, segregating the separated and pulverized unburned carbon portion and the second portion according to centrifugal force resulting from differences in mass, and capturing the now segregated and pulverized unburned carbon portion and second portion to allow for later convenient use.

According to another embodiment of the invention there is provided a separation device, comprising: a casing, the casing includes an inlet for receiving a first material containing at least an unburned carbon portion into the casing, first means for separating the first material into the unburned carbon portion and a second portion, the first means includes second means for reducing in size the unburned carbon portion into a first reduced-size portion and the second portion into a second reduced-size portion, the first means in the casing, segregation means for receiving the first reduced-size portion and the second reduced-size portion from the casing and segregating the first reduced-size portion from the second reduced-size portion for later use whereby the separation device operates economically and effectively, at least one of the first means, the second means and the segregation means being adjustable according to at least one of a size, a density, and an unburned carbon content of the first material whereby the separation device operates economically and accommodates material variation the first material, a first rotation blade in the first means, the first rotation blade having a first rotation axis, a second rotation blade in the first means, the second rotation blade having a second rotation axis, the first rotation blade opposing the second rotation blade in the casing along a common axis of rotation, a pulverization chamber defined between the casing and the first rotation blade and the second rotation blade, the pulverization chamber includes a first width defined as a separation between the first rotation blade and the second rotation blade, the first width being adjustable according to at least the size, the density, and the unburned carbon content of the first material, whereby the separation device is adaptable according to variations in the first material, the first rotation blade includes a blade quantity and a first shape adapted to an inside surface of the casing, the second rotation blade includes a blade quantity and a second shape adapted to the inside surface of the casing, at least one of the first rotation blade and the second rotation blade being rotationally operable at least one of an opposite and a same direction of at least the other of the first rotation blade and the second rotation blade, the first rotation blade and the second rotation blade being rotationally operable according to the inside surface to create circulating vortices within the casing sufficient to cause the separation and the reduction in size of the first material by fracture impact and shear stress, a suction device, a connecting channel connects the suction device to the casing, the suction device drawing gas into the inlet, over the first rotation blade, into the pulverization chamber, and over the second rotation blade to the segregation means to assist the vortices to transport the first material into the separation device for processing, at least one of a first and a second outlet opening on the casing, the at least one outlet opening receiving the first reduced-size portion and the second reduced-size portion from the casing and transferring the first reduced-size portion and the second reduced-size portion to the segregation means, a first storage part in the segregation means, and a second storage part in the segregation means.

According to another embodiment of the invention there is provided a separation device, comprising: a casing, a first rotation blade and a second rotation blade inside the casing operating about a common rotational axis, the first rotation blade and the second rotation blade facing each other in the casing, a pulverization chamber being defined as a space bounded by the first and the second rotation blades and the casing, an inlet opening in the casing adjacent the first rotational blade, the first inlet opening having a shape for receiving a particulate first material containing at least an unburned carbon portion and a second portion, at least one of a first discharge opening and a second discharge opening in the casing adjacent the second rotational blade, the first discharge opening having a position adjacent the common rotational axis of the second rotational blade, and a second discharge opening having a position adjacent an outer circumference of the second rotation blade, and a suction device being connected to the casing opposite the first discharge opening and operating to draw the first particulate material into the casing.

According to another embodiment of the invention there is provided a separation device, wherein: at least of the first rotation blade and the second rotation blade being rotationally operable at least one of an opposite direction and a same direction of at least the other of the first rotation blade and the second rotation blade.

According to another embodiment of the invention there is provided a separation device, further comprising: the first discharge opening, the second discharge opening, and at least one segregation device on at least one of the first discharge opening and the second discharge opening receiving at least one of the unburned carbon portion and the second portion of the first material after precessing.

According to another embodiment of the present invention there is provided a separation device comprising: a casing, the casing includes an inlet for receiving a first material containing at least an unburned carbon portion, first means for separating the first material into the unburned carbon portion and a second portion, the first means includes second means for reducing in size the unburned carbon portion into a first reduced-size portion and the second portion into a second reduced-size portion, the first means in the casing, segregation means for receiving the first reduced-size portion and the second reduced-size portion from the casing and segregating the first reduced-size portion from the second reduced-size portion for later use whereby the separation device operates economically and effectively, at least one of the first means, the second means and the segregation means being adjustable according to at least one of a size, a density, and an unburned carbon content of the first material whereby the separation device operates economically and accommodates material variation the first material, and means for operating the separation device to separate and segregate the unburned carbon particles from the second particles.

According to another embodiment of the present invention, there is provided a separation device, wherein the means for operating includes the steps of: forming a pulverization chamber between the casing and a first and a second rotation blade, the first and the second rotation blades disposed on opposing sides of the pulverization chamber along a common rotational centerline, rotating at least one of the first and the second rotation blades about the common rotational centerline sufficient to create colliding vortices within the pulverization chamber, supplying the first material as particles into the casing at the inlet and the unburned carbon portion having a first specific gravity lower than a second specific gravity of the second portion, separating the first material into the unburned carbon portion and the second portion through at least one of a first process of self-collision with other first material particles and a second process of equipment-collision with the casing and the first and the second rotation blades, reducing in size the unburned carbon portion and the second portion through repeated the at least one process, and segregating the reduced in size unburned carbon portion from the reduced in size second portion, whereby the method for separating operates effectively with increased speed and efficiency.

According to another embodiment of the present invention, there is provided a pulverizer for pulverizing an affluent from a furnace comprising: means for urging said effluent through said pulverizer, at least first and second blades in said pulverizer, and means for rotating said first and second blades at a separation, in a direction, and at a speed effective to form a plurality of vortices which cause multiple collisions of particles of said effluent whereby said particles are separated and reduced in size.

The above, and other objects, features, and advantages of the present invention will become apparent from the following description read in conjunction with the accompanying drawings, in which like reference numerals designate the same elements.

DESCRIPTION OF THE PREFERRED EMBODIMENTS

Figure 1:
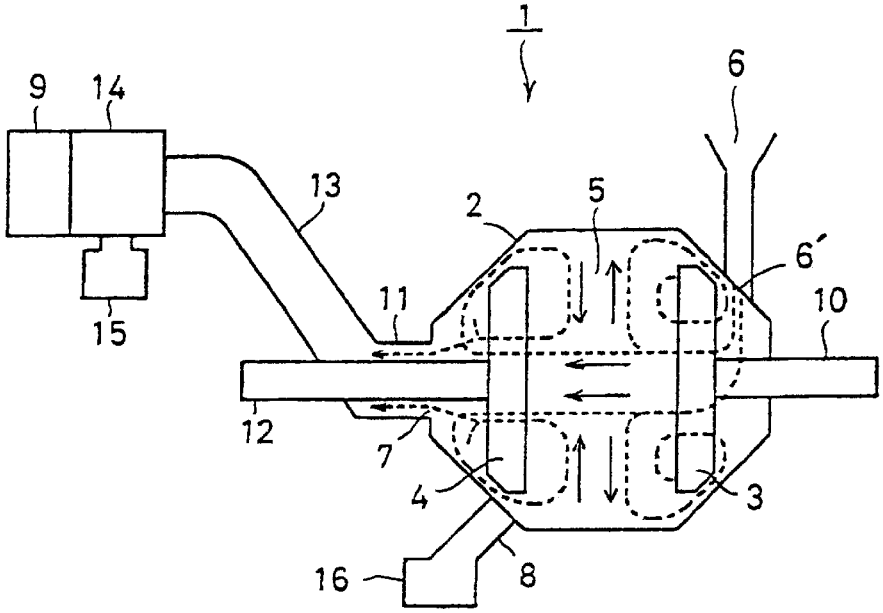
FIG. 1 is a cross-section showing a schematic construction of a first embodiment of a present invention.

Referring now to FIG. 1, a carbon separation device 1, includes a casing 2, a first rotation blade 3, and a second rotation blade 4. Rotation blade 3 and rotation blade 4 are inside casing 2 at positions opposite each other along the same axis of rotation. It is to be understood, that first rotation blade 3 and second rotation blade 4 are each rotationally adjustable and operated by a rotation drive source or a motor (not shown).

A pulverization chamber 5, is defined as a space bounded by rotation blade 3, rotation blade 4, and an inner wall of casing 2. An inlet opening 6, for supplying untreated fly ash to casing 2, connects to casing 2 on a side adjacent first rotation blade 3. A first discharge opening 7, is on casing 2 on a side adjacent a rotation center axis of second rotation blade 4. A second discharge opening 8 is at a position adjacent an outer perimeter of second rotation blade 4.

A connecting passage 13 connects a suction device 9, having variable suction force, to first discharge opening 7, as will be explained.

Inside casing 2, an inner diameter is defined at a center along a longitudinal direction, and is generally uniform. Casing 2 includes left and a right corners each having corresponding sloped-shapes. As a result, casing 2 may be viewed as a tubular member having both ends closed and an inner diameter which gradually reduced towards each side corner or each end.

A first bearing (not shown) is at a center of the right end of casing 2. The first bearing rotatably supports a first support shaft 10 of first rotation blade 3. Near the center of the left end of casing 2, an extension pipe 11 extends axially outward and becomes first discharge opening 7.

A second bearing (not shown) is alternatively at an end of or to an exterior of extension pipe 11. The second bearing rotatably supports a second support shaft 12 of second rotation blade 4.

In the sloping portion of casing 2, to the outside of first rotation blade 3, an opening 6' is positioned. Opening 6' connects inlet opening 6 with casing 2. Second discharge opening 8 is in the sloping portion of casing 2, opposite a tip of second rotation blade 4. Discharge opening 8 has a circumference-shaped opening. It is to be understood, that rotation blade 3 and rotation blade 4 are constructed so that the rotation speeds can be adapted as appropriate during processing, for example from between 5000–10000 rpm.

An end of extension pipe 11 connects with one end of connection passage 13. The other end of connection passage 13 connects with suction device 9. A removal mechanism 14 is on an upstream side of suction device 9. It is to be understood, that removal mechanism 14 may operate to capture and remove unburned carbon from the airflow by a filter or other process. A carbon storage part 15 is at an exit of removal mechanism 14. Carbon storage part 15 operates to store separated and removed unburned carbon after processing. It is to be understood, that the suction force of suction device 9 is designed to be adjustable and vary appropriately depending on the properties of the fly ash to provide smooth operation.

A fly ash storage part 16, which stores treated fly ash, connects to carbon separation device 1 at second discharge opening 8.

In one embodiment, first rotation blade 3 includes four blades (not shown) radially attached to a boss fixed to an end of first support shaft 10. Each blade is arranged at an equal spacing around a circumference of the boss. It is to be understood, that the actual number, shape, and type of blade may be adapted for optimal efficiency. It should be also understood, that wide spaces between the blades provides preferable airflow.

Similar to first rotation blade 3, second rotation blade 4 may have four blades radially attached to a boss fastened to an end of second support shaft 12.

In the present embodiment, first support shaft 10 and second support shaft 12 are adjustable in an axial direction for optimal efficiency. An interval or distance between rotation blade 3 and rotation blade 4, also defined as a width of pulverization chamber 5, is therefore adjustable. Depending on the properties of the input fly ash to be treated, an optimal interval is achievable through adjustment of either one or both of first support shaft 10 or second support shaft 12. It should also be understood, that the width of pulverization chamber 5 may be adjusted by either or both support shafts.

In another embodiment, casing 2 is constructed so that it can be split from the center for simple maintenance and inspection. During operation, first rotation blade 3 and second rotation blade 4 rotate while suction device 9 operates. The rotation of rotation blades 3, 4 and operation of suction device 9 each create desirable air vortices within casing 2 and pulverization chamber 5 which act to assist processing and transfer of the particles added to casing 2. It is to be understood, that inside pulverization chamber 5, and casing 2, the circulation path (in other words the circulation airflow) of first rotation blade 3 and the circulation path of second rotation blade 4 each have velocity components. These velocity components may be in the same or opposite directions to each other. As a result, of these velocity components, particles added to the respective circulation paths collide with each other.

During operation, untreated fly ash particles are added to inlet opening 6, and enter one side of casing 2 through opening 6'. The fly ash particles approach first rotation blade 3 and pass through the spaces between the blades on first rotation blade 3. A portion of the particles ride on the airflow generated by the rotation of the blades and circulates around and through first rotation blade 3.

Through the action of both blades and suction device 9, an additional portion of the particles are pulled towards second rotation blade 4 and similarly circulate around second rotation blade 4. During circulation, the particles collide primarily with each other but also with various equipment pieces. During each collision, a shearing stress results. The collision shear stress to each particle is sufficient to pulverize the particles.

It should be understood, that since silicon oxide particles and aluminum oxide particles are extremely hard, even if they collide with each other, generally only the aggregates are separated and complete pulverization is difficult. However, untreated fly ash is a powder of mixed particles of silicon oxide, aluminum oxide, and particles of unburned carbon. The unburned carbon is softer than either silicon oxide or aluminum oxide and is more easily sheared.

During operation, where particles of silicon oxide or aluminum oxide (or both aggregated) collide with unburned carbon particles, the unburned carbon breaks down. Each collision easily pulverizes unburned carbon into ever-finer particles. During operation, the untreated fly ash circulates on the multiple circulation paths by riding the air flows, and multiple collisions occur. During operation, repeated micron or submicron pulverization is selectively conducted on the unburned carbon, and the unburned carbon gradually reaches a finer and finer particle size.

It should be understood, that even when the carbon and other particles have the same size, silicon oxide and aluminum oxide have a greater specific gravity (density) compared to the particles of unburned carbon. As a result, when circulating on the various circulation paths, especially when flowing outward along the radial direction of each rotation blade 3, 4, the particles of silicon oxide and aluminum oxide flow outward with a larger centrifugal force than the unburned carbon particles. As a result of these properties, the unburned carbon particles, are more easily suctioned along the rotation center axis of second rotation blade 4 and are easily discharged from first discharge opening 7.

Since silicon oxide and aluminum oxide have a larger mass and a heavier specific gravity, they flow more easily outward in the radial direction of the circulation path of second rotation blade 4. It should be understood, that since carbon particles are relatively light and fly ash particles are relatively heavy, during operation and circulation on the circulation paths, the aggregated particle masses are dispersed and become pulverized into spherical particles, and due to differences in the centrifugal force acting on each particle, the direction of flow is different, and simplified separation is possible.

During operation therefore, the particles of fly ash, having relatively large mass and heavy specific gravity, are easily processed into second discharge opening 8, which is opened facing a tip of second rotation blade 4. During prolonged operation, particles of fly ash are gradually stored inside fly ash storage part 16 for later removal. In an alternative embodiment, an additional suction device may operation on fly ash storage part 16, and particles of fly ash can be gradually led into fly ash storage part 16 through both operational processing and influence from the vacuum.

During operation particles of fly ash are gradually collected, and the unburned carbon particles, are suctioned from first discharge opening 7 and discharged outside of casing 2 for storage in carbon storage part 15 via a removal mechanism 14. In this manner, the fly ash stored in fly ash storage part 16 has a low content of unburned carbon. The fly ash particles which were previously aggregated are now dispersed and generally spherical, and a high quality fly ash is achieved. The high quality fly ash is more desirable for later recycling and economic use.

The device and method described allow easy manipulation of several process controls adaptable to produce a desired result. The adjustable process controls include changing the rotation speeds and directions of first rotation blade 3 and second rotation blade 4, changing the input amount, changing the suction force of suction device 9, and changing the pulverization or processing time. Through manipulation of these process controls, the unburned carbon processing is adaptable to different types of fly ash.

It should be understood, that the process is adaptable to the operation of first rotation blade 3 and second rotation blade 4 rotating in either the same or opposite directions according to demand. Operation in the same direction still results in multiple collisions. However, by reversing the rotation directions of each blade, shearing stress is increased, not only in the radial direction of each rotation blade but also along the counter-rotation direction. As a result, the pulverization efficiency is improved.

Figure 2:
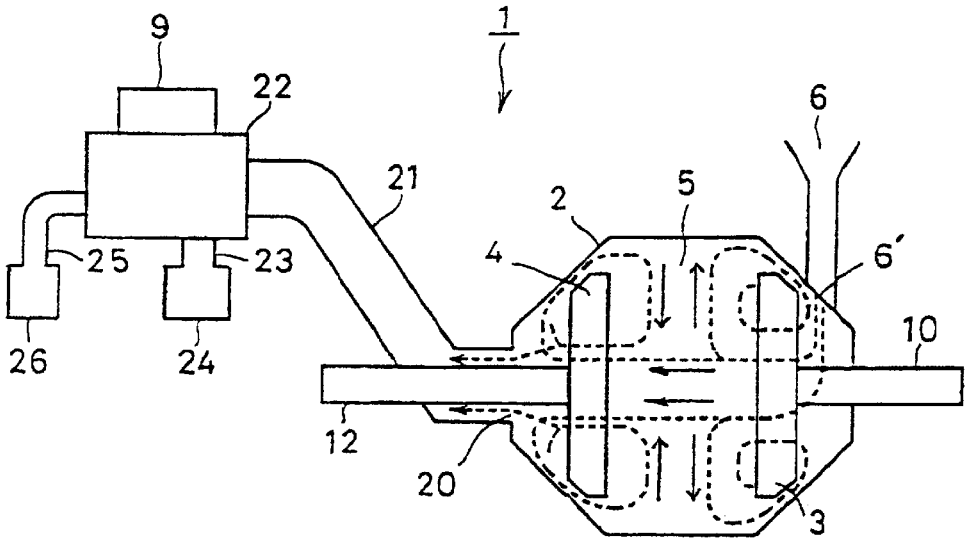
FIG. 2 is a cross-section showing a schematic construction of a second embodiment of the present invention.

Additionally referring now to FIG. 2, another embodiment includes a discharge opening 20 at a center portion of casing 2 along the side of second rotation blade 4. A connection passage 21 connects suction device 9 to discharge opening 20. A classification device 22, classifies the fly ash discharged from discharge opening 20, and connects with discharge opening 20. A carbon storage part 24 is on a first removal opening 23 of classification device 22. A fly ash storage part 26 is on a second removal opening 25.

During operation of this embodiment of carbon separation device 1, first rotation blade 3 and second rotation blade 4 rotate while suction device 9 and classification device 22 operate.

Fly ash is added to inlet opening 6, and enters casing 2 through opening 6' to the right end of casing 2. Fly ash then passes through the blades of first rotation blade 3 and a portion of the particles ride on the airflow generated by the rotation of the blades and circulate around first rotation blade 3. Another portion of the particles pass to second rotation blade 4 and similarly circulate around second rotation blade 4.

During normal operation, the circulation path of first rotation blade 3 and the circulation path of second rotation blade 4 inside pulverization chamber 5 are opposites. Since the velocity components of each blade are in opposite directions the particles on each of the circulation paths collide with each other, receive a shearing stress, and are pulverized. First rotation blade 3 and second rotation blade 4 may also rotate in the same direction depending upon processing demand.

As described above, the fly ash, which is now processed and pulverized to a micron and sub-micron level, is suctioned from discharge opening 20 and is discharged to the outside of casing 2 along connecting passage 21. The discharge is primarily, but not completely driven by suction device 9. In alternative embodiments, gravity discharge may be used.

The discharged fly ash includes a mixture of silicon oxide particles, aluminum oxide particles, and unburned carbon particles. This mixture is supplied to classification device 22 for classification according to at least size but also possible chemical content, mass and other factors.

It is noted again, that the particles of fly ash have a heavier specific gravity (greater mass) than the unburned carbon particles. As a result, fly ash has the property of flowing outward with a greater centrifugal force than the unburned carbon particles. The particles of unburned carbon, having a lower mass, can be separated from the fly ash particles by mass or other means. Fly ash particles having a heavier specific gravity are stored in fly ash storage part 26. Unburned carbon particles having a lighter specific gravity are stored in carbon storage part 24.

Due to the segregation described above, the fly ash stored in fly ash storage part 26 has a lower content of unburned carbon than non-processed fly ash. The aggregated particles are dispersed and are pulverized into generally spherical particles. The resulting processed fly ash has an increased economic viability.

Figure 3:
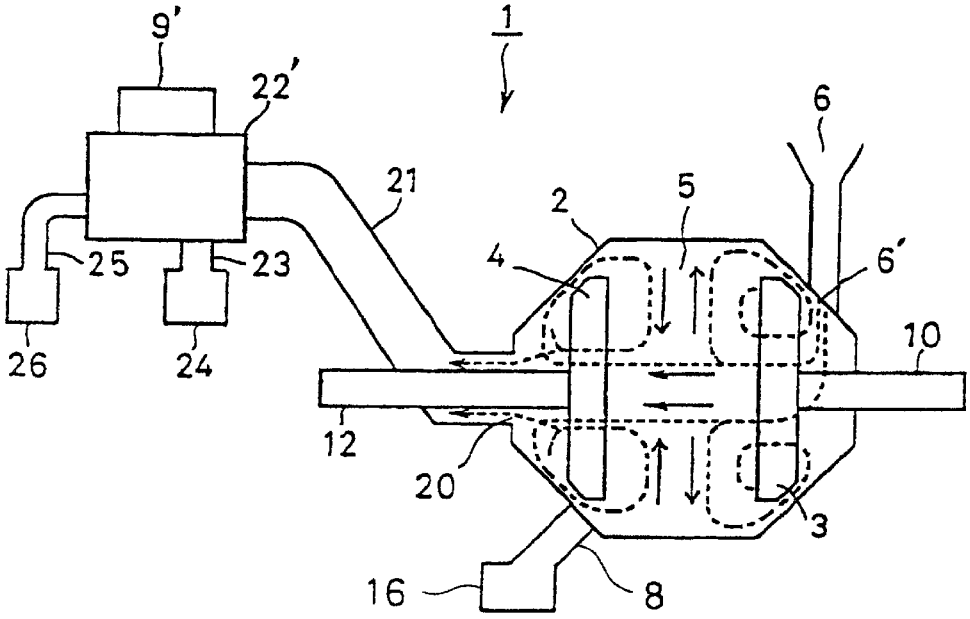
FIG. 3 is a cross-section showing the schematic construction of a third embodiment of the present invention.
Figure 4:
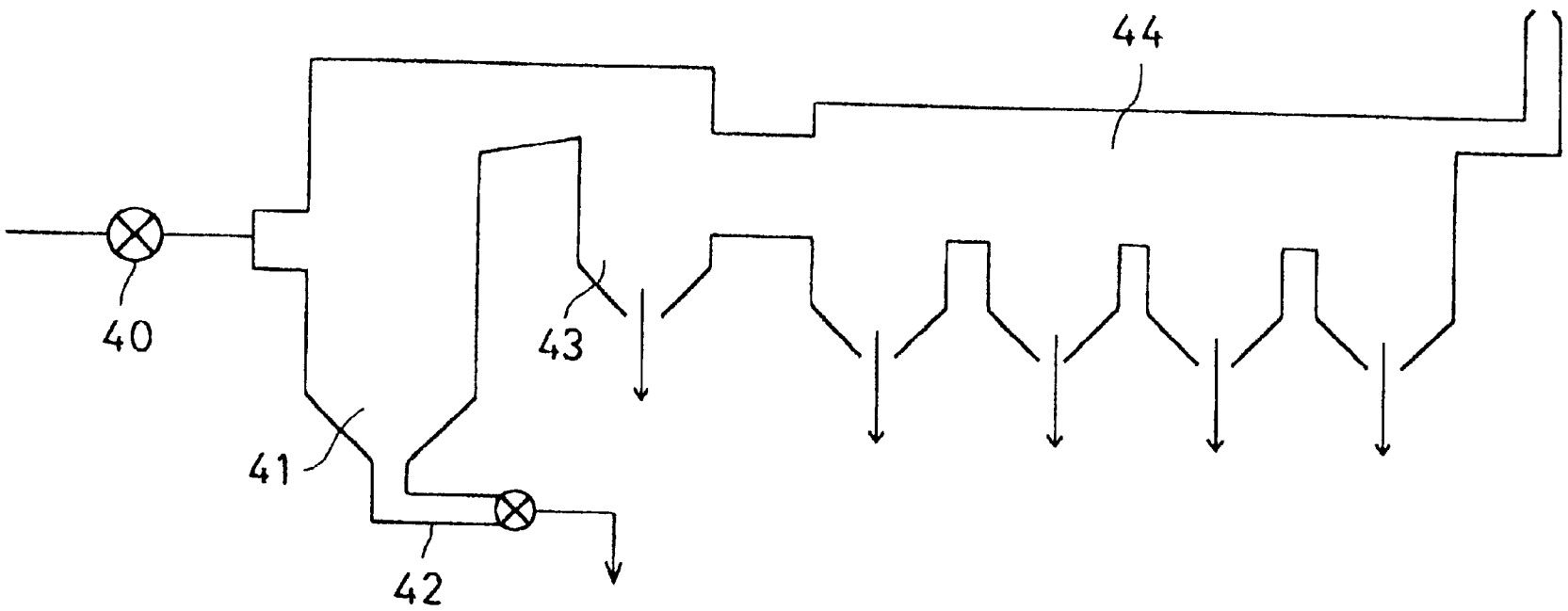
Prior Art Fig. 4
FIG. 4 is a schematic descriptive drawing of a conventional boiler of a coal-fired power plant.

Additionally referring now to FIG. 3, an additional embodiment includes fly ash storage part 16 and second discharge opening 8 along with the previous embodiment. Discharge opening 20 is still opened at the center of casing 2 on the side of second rotation blade 4. A suction device 9' and a classification device 22' connects with discharge opening 20. Suction device 9' operates to draw air through carbon separation device 1. Classification device 22' conducts a graduated classification of the fly ash discharged from discharge opening 20 using mass difference and specific gravity difference of the particles.

First rotation blade 3, second rotation blade 4, fly ash storage 16, suction device 9', classification device 22', and the other elements shown have a similar construction as in each of the previously described embodiments.

Using this embodiment, untreated fly ash is pulverized to the micron or sub-micron level. Most of the processed fly ash with a large specific gravity is collected from second discharge opening 8 into fly ash storage 16. However, even where fly ash is discharged through discharge opening 20 together with unburned carbon that has not been collected from second discharge opening 8, the unburned carbon is separated and collected by classification device 22'. As a result, the combined segregation process of this embodiment improves fly ash collection efficiency.

As described in the present invention, second discharge opening 8, for removing fly ash particles, is on casing 2 at a position along an extension line from the tip of second rotation blade 4. It is to be understood, that second discharge opening 8 need only be at a position that is farther from the rotation center of the rotation blade than first discharge opening 7 or discharge opening 20 in either embodiment. For example, second discharge opening 8 can be at a shoulder of casing 2 where circulation airflow likely makes collection advantageous.

It should be understood, that using the device and method described above, fly ash with high unburned carbon content can be simply and cheaply reduced to fly ash with a low unburned carbon content. This advantage provides increased use of fly ash as a raw material for second source uses, reduces landfill waste and reduces disposal and raw material costs.

Using the present invention, a stable supply and quality of fly ash can be produced and alternative technologies more simply developed. For example, when treated and processed fly ash is used as a concrete admixture, the fluidity of the concrete is improved. With this improved raw material, applications with concrete admixtures can be expanded. Since the processed fly ash particles are pulverized and dispersed as spherical primary particles the rheological bearing effect is heightened, and as a result, the fluidity of the concrete is desirably heightened.

As an additional benefit, untreated carbon particles can be selectively and very finely pulverized from the untreated fly ash. Since the pulverization is due to circulating airflow and vortices, pulverization can be conducted to the sub-micron level, as demanded by a customer using the process variables. As another benefit, using the classification process of the present invention, trace elements contained in the fly ash can be separated and reduced at the same time as the reduction in the unburned carbon.

Some trace elements are toxic. The separation and reduction of toxic substances, which can become the source for environmental contamination, is a benefit. By achieving a reduction in toxic substances, the possible uses of fly ash as a raw material may be further expanded.

It is to be understood as an additional benefit, that since the present invention employs gaseous pulverization and particles on circulation paths with opposing velocity components collide and create a shearing stress primarily on each other thus reducing equipment abrasion and reducing costs.

The carbon particles and the silicon particles are separated by a classification device using differences in mass and differences in specific gravity. As a result, customers have increased raw material selection depending on size and specific gravity and design freedom is increased.

Since classification performance and pulverization performance are individually adjustable, design freedom is further increased.

Since the process variables include those listed above, pulverization conditions can be optimized according to the properties of the untreated fly ash and unburned carbon can be efficiently separated with desired variable particle size distributions.

It is to be understood, that the phrase pulverizing as used in the disclosure means both breaking aggregated particles apart and also into smaller sizes through primarily self-collision during processing. It is to be understood, that where equipment-collision occurs, it will be a minor portion when referenced to the primary self-collision portion.

It is to be understood, that the pulverization method and conditions described above are methods to reduce the size of the untreated fly ash. The method for reduction includes ways to both reduce the size of the process fly ash and the size of the unburned carbon as is desired by a customer.

It should be understood, that suction device 9 acts as one type of urging device to promote movement of material into the pulverization chamber, but other types of urging devices are possible including adaptive use of gravity.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A separation device, comprising:

a casing;

said casing includes an open inlet for continuously receiving a first material containing at least an unburned carbon portion and a second portion;

first means for separating said first material into said unburned carbon portion and said second portion;

said first means includes second means for reducing in size at least said unburned carbon portion into a first reduced-size portion and said second portion into a second reduced-size portion;

said first means in said casing; and segregation means for receiving said first reduced-size portion and said second reduced-size portion from said casing and segregating said first reduced-size portion from said second reduced-size portion for later use whereby said separation device operates economically and effectively.

2. A separation device, according to claim 1, wherein:

at least one of said first means, said second means and said segregation means being adjustable according to at least one of a size, a density, and an unburned carbon content of said first material whereby said separation device operates economically and accommodates material variation said first material.

3. A separation device, according to claim 2, further comprising:

a first rotation blade in said first means;

said first rotation blade having a first rotation axis;

a second rotation blade in said first means;

said second rotation blade having a second rotation axis;

said first rotation blade opposing said second rotation blade in said casing along a common axis of rotation; and a pulverization chamber defined between said casing and said first rotation blade and said second rotation blade.

4. A separation device, according to claim 3, wherein:

said pulverization chamber includes a first width defined as a separation between said first rotation blade and said second rotation blade; and said first width being adjustable according to at least said size, said density, and said unburned carbon content of said first material, whereby said separation device is adaptable according to variations in said first material.

5. A separation device, according to claim 4, wherein:

said first rotation blade includes a blade quantity and a first shape adapted to an inside surface of said casing;

said second rotation blade includes a blade quantity and a second shape adapted to said inside surface of said casing;

at least one of said first rotation blade and said second rotation blade being rotationally operable at least one of an opposite direction and a same direction of at least said other of said first rotation blade and said second rotation blade; and said first rotation blade and said second rotation blade being rotationally operable according to said inside surface to create circulating vortices within said casing sufficient to cause said separation and said reduction in size of said first material by fracture impact and shear stress.

6. A separation device, according to claim 5, further comprising:

a suction device;

a connecting channel connecting said suction device to said casing; and said suction device drawing a gas containing said first material into said inlet, over said first rotation blade, into said pulverization chamber, and over said second rotation blade to said segregation means to assist said vortices to transport said first material into said separation device for processing.

7. A separation device, according to claim 6, further comprising:

at least one of a first and a second outlet opening on said casing; and said at least one outlet opening receiving said first reduced-size portion and said second reduced-size portion from said casing and transferring said first reduced-size portion and said second reduced-size portion to said segregation means.

8. A separation device, according to claim 7, further comprising:

a first storage part in said segregation means;

a second storage part in said segregation means;

said first storage part formed for receiving and segregating said first reduced-size portion depending upon a particle size and a mass of said first reduced-size portion; and said second storage part formed for receiving and segregating said second reduced-size portion depending upon a particle size and a mass of said second reduced size-portion, whereby said separation device provides easy separation of said unburned carbon from said second portion.

9. A separation device, according to claim 8, further comprising:

said first and said second outlet opening;

said first outlet opening at a first position on said casing adjacent said first rotation axis receives said first reduced-size portion; and said second outlet opening at a second position on said casing adjacent an outer circumference of said second rotation blade receives said second reduced-size portion; whereby segregation of particle size and mass is simplified.

10. A separation device, according to claim 9, wherein:

said first inlet opening is at a third position on said casing adjacent an outer circumference of said first rotation blade.

11. A separation device, according to claim 10, further comprising:

a classification device in said segregation means;

said connecting channel connects said classification device to said casing; and said classification device receives discharged particles of said first reduced-size portion and said second reduced-size portion and uses differences in mass and density of said discharged particles to classify them for later use.

12. A method for separating unburned carbon in a first material containing both an unburned carbon portion and a second portion, comprising the steps of:

operating a pulverization chamber comprising first and said second rotation blades disposed on opposing sides of said pulverization chamber along a common rotational centerline;

rotating at least one of said first and said second rotation blades about said common rotational centerline at least one of a speed and a separation sufficient to create colliding vortices within said pulverization chamber and said bounding casing;

supplying said first material as particles into a bounding casing from a first position on said bounding casing and said unburned carbon portion having a first specific gravity lower than a second specific gravity of said second portion;

separating said first material into said unburned carbon portion and said second portion through at least one of a first process of self-collision with other first material particles and a second process of equipment-collision with said bounding casing and said first and said second rotation blades;

reducing in size said unburned carbon portion and said second portion through repeated said at least one of said first and said second process;

segregating said reduced in size unburned carbon portion from said reduced in size second portion;

receiving said reduced in size and said segregated unburned carbon portion in a first discharge opening on said bounding casing; and receiving said reduced in size and segregated second portion in a second discharge opening on said bounding casing, whereby said first material is efficiently and simply pulverized, reduced in size, and segregated for later use, whereby said method for separating operates effectively with increased speed and efficiency.

13. A method for separating, according to claim 12, wherein:

said first position on said bounding casing surface is adjacent an outer circumference of said first rotation blade;

said first discharge opening is adjacent a rotation center axis of said second rotation blade, whereby said unburned carbon particles having lower centrifugal force than said second portion are easier to separate; and said second discharge opening on said casing is adjacent an outer perimeter portion of said second rotation blade, where said second portion having a higher centrifugal force that said unburned carbon portion are easier to separate.

14. A method for separating unburned carbon in a first material containing both an unburned carbon portion and a second portion, comprising the steps of:

supplying said first material in particulate form to a pulverization chamber, which comprises:

an open inlet for continuously receiving said first material, at least a first and a second rotation blade disposed in an opposing manner along a single rotational axis, on a first side adjacent said first rotation blade;

rotating at least one of said first rotation blade and said second rotation blade along said single rotational axis and providing colliding air vortices within said pulverization chamber;

colliding particles of said first material on said colliding air vortices with each other to separate said unburned carbon portion from said second portion;

pulverizing said unburned carbon portion and said second portion by repeated collision;

segregating said separated and pulverized unburned carbon portion and said second portion according to centrifugal force resulting from differences in mass; and separately capturing the now segregated and pulverized unburned carbon portion and second portion to allow for later convenient use and discard.

15. A separation device, comprising:

a casing;

said casing includes an inlet for receiving a first material containing at least an unburned carbon portion into said casing;

a first means for separating which separates said first material into said unburned carbon portion and a second portion;

said first means includes a means for reducing in size said unburned carbon portion into a first reduced-size portion and said second portion into a second reduced-size portion;

said first means disposed within said casing;

a segregation means which receives said first reduced-size portion and said second reduced-size portion from said casing and segregates said first reduced-size portion from said second reduced-size portion for later use whereby said separation device operates economically and effectively;

at least one of said first means, said means for reducing and said segregation means being adjustable according to at least one of a size, a density, and an unburned carbon content of said first material whereby said separation device operates economically and accommodates material variation said first material, a first rotation blade in said first means;

said first rotation blade having a first rotation axis;

a second rotation blade in said first means;

said second rotation blade having a second rotation axis;

said first rotation blade opposing said second rotation blade in said casing along a common axis of rotation;

a pulverization chamber defined between said casing and said first rotation blade and said second rotation blade;

said pulverization chamber includes a width defined as a separation between said first rotation blade and said second rotation blade;

said width being adjustable according to at least one of said size, said density, and said unburned carbon content of said first material, whereby said separation device is adaptable according to variations in said first material;

said first rotation blade includes a blade quantity and a first shape adapted to an inside surface of said casing;

said second rotation blade includes a blade quantity and a second shape adapted to said inside surface of said casing;

at least one of said first rotation blade and said second rotation blade being rotationally operable at least one of an opposite and a same direction of at least said other of said first rotation blade and said second rotation blade;

said first rotation blade and said second rotation blade being rotationally operable according to said inside surface to create circulating vortices within said casing sufficient to cause said separation and said reduction in size of said first material by fracture impact and shear stress;

a suction device;

a connecting channel which connects said suction device to said casing;

said suction device draws gas into said inlet, over said first rotation blade, into said pulverization chamber, and over said second rotation blade to said segregation means to assist said vortices to transport said first material into said separation device for processing;

at least one of a first and a second outlet opening on said casing;

at least one of said first and said second outlet opening receives said first reduced-size portion and said second reduced-size portion from said casing and transfers said first reduced-size portion and said second reduced-size portion to said segregation means;

a first storage part in said segregation means; and a second storage part in said segregation means.

16. The separation device of claim 15, wherein said inlet is open and continuously receives said first material.

17. A separation device, comprising:

a casing;

a first rotation blade and a second rotation blade inside said casing operating about a common rotational axis;

said first rotation blade and said second rotation blade facing each other in said casing;

a pulverization chamber being defined as a space bounded by said first and said second rotation blades and said casing an inlet opening in said casing adjacent said first rotational blade;

said inlet opening having a shape for receiving a particulate first material containing at least an unburned carbon portion and a second portion;

at least one of a first discharge opening and a second discharge opening in said casing adjacent said second rotational blade;

said first discharge opening having a position adjacent said common rotational axis of said second rotational blade;

and a second discharge opening having a position adjacent an outer circumference of said second rotation blade; and a suction device being connected to said casing opposite said first discharge opening and operating to draw said first particulate material into said casing.

18. A separation device, according to claim 17, wherein:

at least one of said first rotation blade and said second rotation blade being rotationally operable in at least one of an opposite direction and a same direction of at least said other of said first rotation blade and said second rotation blade.

19. A separation device, according to claim 18, further comprising:

at least one segregation device on at least one of said first discharge opening and said second discharge opening receiving at least one of said unburned carbon portion and said second portion of said first material after processing.

20. The separation device of claim 17, wherein said inlet opening continuously receives said first material particulate.

21. A separation device, comprising:

a casing;

said casing includes an open inlet for continuously receiving a first material containing at least an unburned carbon portion and a second portion;

a first means for separating which separates said first material into said unburned carbon portion and said second portion;

said first means includes a means for reducing in size at least said unburned carbon portion into a first reduced-size portion and said second portion into a second reduced-size portion;

said first means disposed within said casing;

a segregation means which receives said first reduced-size portion and said second reduced-size portion from said casing and segregates said first reduced-size portion from said second reduced-size portion for later use whereby said separation device operates economically and effectively;

at least one of said first means, said means for reducing and said segregation means being adjustable according to at least one of a size, a density, and an unburned carbon content of said first material whereby said separation device operates economically and accommodates material variation said first material; and means for operating said separation device to separate and segregate said unburned carbon particles from said second particles.

22. A separation device, according to claim 21, wherein said means for operating comprises:

a pulverization chamber between said casing and a first and a second rotation blade;

said first and said second rotation blades disposed on opposing sides of said pulverization chamber along a common rotational centerline;

colliding vortices within said pulverization chamber created by rotating at least one of said first and said second rotation blades;

said first material is a particulate supplied into said casing at said inlet;

said unburned carbon portion having a first specific gravity and said second portion having a second specific gravity, wherein said first specific gravity is lower than said second specific gravity;

at least one of a first process of self-collision between said first material particulate with other first material particulate and a second process of equipment-collision between said first material particulate and said casing and said first and said second rotation blades;

wherein at least one of said first and said second process reduces in size said unburned carbon portion and said second portion; and said reduced in size unburned carbon portion is segregated from said reduced in size second portion, whereby said method for separating operates effectively with increased speed and efficiency.

23. A pulverizer for pulverizing an effluent from a furnace comprising:

means for urging said effluent through said pulverizer;

at least first and second blades in said pulverizer; and means for rotating said first and second blades at a separation, in a direction, and at a speed effective to form a plurality of vortices which cause multiple collisions of particles of said effluent whereby said particles are separated and reduced in size.

24. The pulverizer of claim 23 further comprising:

a casing, wherein said casing comprises an inlet opening which continuously receives said effluent.

* * * * *